US005414889A

United States Patent [19]

Sartori

[11] Patent Number: 5,414,889

[45] Date of Patent: May 16, 1995

[54] BROOM WITH POSITION-MAINTAINING MULTI-ANGLE HANDLE INTERCONNECTOR

[75] Inventor: Francesco Sartori, Bologna, Italy

[73] Assignee: M. B. Walton, Inc., Rosemont, Ill.

[21] Appl. No.: 212,952

[22] Filed: Mar. 15, 1994

Related U.S. Application Data

[63] Continuation-in-part of Ser. No. 17,537, Jan. 14, 1994.

[51] Int. Cl.[6] ..... B25G 1/06; A46B 15/00

[52] U.S. Cl. ..... 15/159.1; 15/144.1; 15/171; 15/172; 15/175

[58] Field of Search ..... 15/145, 144.1, 172, 15/229.6, 229.7, 229.8, 229.9, 235.8; 294/53.5; 403/103, 105

[56] References Cited

U.S. PATENT DOCUMENTS

| | | | |
|---|---|---|---|
| 357,408 | 2/1887 | Pittenger | 294/53.5 |
| 612,491 | 10/1898 | Eck | 15/172 |
| 624,310 | 5/1899 | Eck | 15/144.1 |
| 1,810,026 | 6/1931 | Moller | 294/53.5 |
| 2,032,664 | 3/1936 | Raptis | 15/172 |
| 3,795,933 | 3/1974 | Seufert | 15/144.1 |
| 4,658,461 | 4/1987 | Roe | 15/145 |

FOREIGN PATENT DOCUMENTS

| | | | |
|---|---|---|---|
| 899033 | 12/1953 | Germany | 15/172 |
| 109977 | 3/1944 | Sweden | 294/53.5 |

*Primary Examiner*—David A. Scherbel
*Assistant Examiner*—Randall E. Chin
*Attorney, Agent, or Firm*—Leydig, Voit & Mayer, Ltd.

[57] ABSTRACT

A versatile broom, brush or similar floor care implement comprises a head anchoring on a first side thereof a multiplicity of bristles presenting a substantially-flat bristle surface, and an integrally-formed connector-mating structure on an opposed second side of the head. The cleaning implement is maneuvered by an elongated handle disposed at a variety of preselected angles. Intermediate the head and handle is a handle interconnector to which the handle is detachably secured at one extremity and a connection assembly is ratchetably-pivotably secured at the other extremity. The connection assembly and the integrally-formed connector-mating structure on the head interact so that the handle can be selectively pivoted in a single plane as much as 180° or more and locked at any of a number of preselected angles relative to the substantially-flat bristle-end surface.

3 Claims, 4 Drawing Sheets

BROOM WITH POSITION-MAINTAINING MULTI-ANGLE HANDLE INTERCONNECTOR

This utility application is a continuation-in-part of applicant's co-pending U.S. Design patent application Ser. No. 29/017,537, filed on Jan. 14, 1994, entitled "Broom with Multi-Angle Handle Interconnector".

BACKGROUND OF THE INVENTION

1. Field of the Invention

The present application relates to a versatile broom, brush or similar floor-care implement which can be readily adjusted for optimized multiple applications, including conventional side-to-side floor whisking, push-broom sweeping and confined-space cleaning. More specifically, it relates to a multi-function, ergonomically-correct broom wherein the handle may be conveniently, quickly and changeably disposed and locked at a preselected one of a number of desired angles relative to the plane of the bristles in contact with the surface so as to enhance sweeping effectiveness and efficiency, regardless of changing sweeping requirements, which broom can be manufactured at a competitive cost.

2. Discussion of Prior Art

The working medium of floor care brushes, brooms and like usually comprises a multiplicity of oriented bristles or bristle tufts embedded and supported in a bristlehead or broomhead or other head at one extremity of the bristles and presenting a substantially-flat, exposed bristle-end contacting surface at the other extremity of the bristles for contact with the surface to be swept. To optimize sweeping efficiency, the bristle-end area in actual contact with the surface to be swept should preferably be maximized. To achieve this efficiency, the broom handle should be disposed relative to the broom head so that contact area is maximized while at the same time accommodating the normal sweeping angle and action of the user. This requirement is complicated by the aforementioned several different types of sweeping operations, variations in physical size of the user and the preferred angular dispositions of the broom handle desired by each user for each type of sweeping.

Thus, for example, for side-to-side sweeping action the axis of the handle should preferably be substantially vertically disposed relative to the plane of the contacting bristle surface. For a forward-facing push-broom type of sweeping, however, the handle axis should preferably be disposed at a convenient angle, e.g., about 40°–60° relative to the plane of the contacting surface, depending in part on the physical size of the user and the user's preference. For sweeping underneath furniture and other objects having very limited surface clearance, the handle axis should preferably be disposed substantially parallel to the plane of the contacting surface, or approaching such relationship, to permit handle entry along with maximized bristle area contact.

In addition, the broom should be bi-directional, that is, the handle should be reversible from one side of the head to the other. Such bi-directional disposition balances wear and bristle flexing and curvature due to sweeping stresses over long periods of use, particularly when used in a one-way push broom mode, thereby assuring long life of the bristles.

To meet these sometimes-conflicting needs, the prior art discloses various means of hinging broom handles to the broom head. Thus, for example, applicant herein has disclosed in U.S. Pat. No. 4,796,324, issued Jan. 10, 1989, a broom or brush with a hinged handle which effectively copes with the problem of sweeping underneath furniture and other confined spaces while still being suited for normal push broom operation. The same design, however, does not fully meet the requirements of still other sweeping applications referred to hereinabove and otherwise.

Still other approaches have been accompanied by shortcomings from a manufacturing or cost standpoint or from a user's preference standpoint. For example, prior art interconnection means between the broom head and the handle have involved an undue number of parts or complicated assembly with consequent high cost of manufacture and assembly. The resulting product has often been found to be inconvenient to use, or unacceptable from an ergonomic standpoint or require skill or practice by the user for effective and efficient sweeping, or otherwise suffer from the perception of not being user-friendly, a real sales deterrent. Some even require special broom handles and the like.

OBJECTS OF THE INVENTION

Accordingly, it is an object of the present invention to avoid the shortcomings of the prior art and to meet the various needs hereinabove set forth at an acceptable low cost. These and other objects of the present invention will become apparent as the detailed description proceeds.

SUMMARY OF THE INVENTION

These objects are achieved by a cleaning implement such as a broom or the like comprising a head which may be of conventional design or otherwise. The head typically anchors on a first or lower side the upper extremity of a multiplicity of bristles or bristle tufts. The lower extremity of the bristles typically present a substantially-flat and continuous bristle-end surface for contact with the usually-flat surfaces to be cleaned. On the second or upper side of the head is a connection assembly described hereinafter. The cleaning implement is maneuvered or manipulated by the user by means of an elongated handle which may also be of conventional design.

Intermediate the head and handle is a novel handle interconnector having a handle end and a bristlehead end. The handle is detachably secured to the handle end of the interconnector, preferably by conventional threaded means, thus permitting the use of conventional handles, if desired. Disposed on the other or broomhead end of the interconnector is a simple connection assembly which is ratchetably-pivotally secured to an integrally-formed cooperating structure on the adjacent or second side of the bristlehead. This cooperating structure is also referred to herein as an integrally-formed interconnector mating structure.

The connection assembly on the broomhead end of the interconnector and the integrally-formed cooperating structure on the head are designed so that the handle can be selectively-rotated in a single plane as much as 180° or more and locked at any of a number of predetermined desired angles relative to the substantially-flat bristle surface. These angular relationships include a vertical relationship, substantially-parallel relationships on either side of the vertical, and intermediate angles between these extremes.

The integrally-formed, interconnector-mating structure comprises a semi-circular-shaped upraised portion of the second side having opposed pivot pins or journals adjacent the center and tooth-like projections on the circular periphery thereof. Typically, the head is molded plastic whereby the integrally-formed interconnector-mating structure is advantageously included as part of the head in a single molding step forming the head.

The connection assembly itself comprises bifurcated extensions of the broom head end of the interconnector having opposed apertures therein for pivoted connection to pivot pins of the integrally-formed interconnector-mating structure of the head. The connection assembly also includes a manually-operated adjuster which is biased so as to establish a preselected fixed angular association or relationship between the handle and the substantially-flat bristle-end surface. The adjuster preferably comprises a spring-loaded movable fitting having a projection interfitting the tooth-like projections on the circular periphery of the integrally-formed interconnector-mating structure of the broomhead.

By employing an integrally-formed structure on the head to cooperate with the connection assembly of the interconnector, the number of components and thus the assembly and manufacturing costs are substantially reduced. The resulting versatile broom provides ergonomically-correct, user-friendly performance and cleaning superiority.

As will be apparent from the drawings hereinafter described, the pivot pins of the integrally-formed interconnector-mating structure of the head and the distal ends of the bifurcated extensions of the head end of the interconnector are mutually beveled to facilitate one-way snap-fitting assembly. In a preferred embodiment, a supplemental interference structure is also detachably provided to inhibit any inadvertent disassembly of the resulting snap-fitted pivotal connection.

BRIEF DESCRIPTION OF THE DRAWINGS

The present invention may be more clearly understood from the following description of a specific and preferred embodiment read in conjunction with the accompanying drawings wherein.

Figure 1:
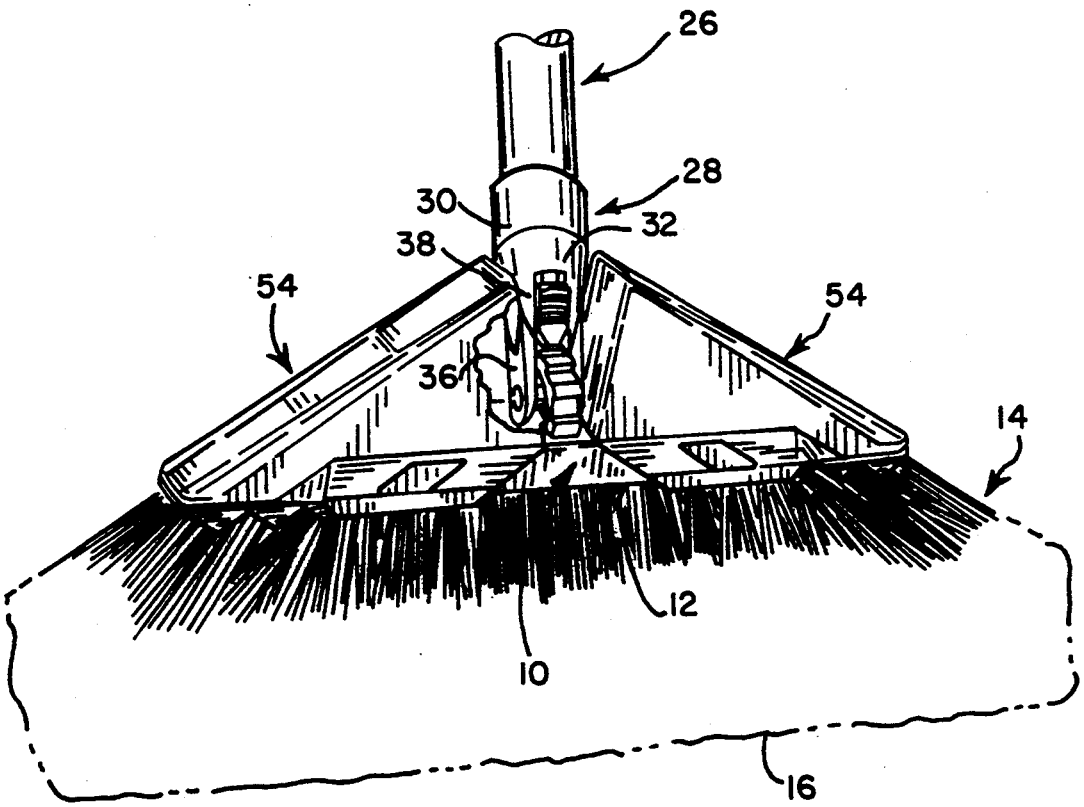
FIG. 1 is a broken-way, fragmentary perspective view of a preferred broom embodiment of the present invention wherein the interconnector and handle are disposed and releasably-locked at an intermediate angle in the normal push-broom sweeping disposition between the vertical and horizontal relative to the flat sweeping surface of the illustrated broom.
Figure 3:
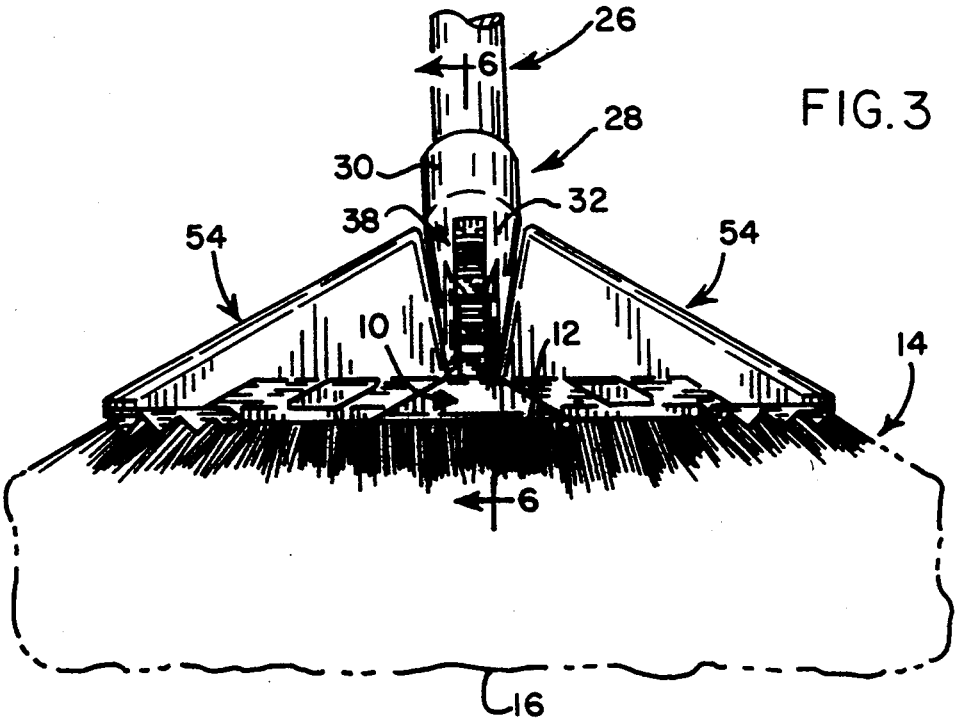
FIG. 3 is a fragmentary front view similar to FIG. 1.

It should be understood that when referring to physical relationships of components by the terms such as "bottom", "top", "right", "left", "overhead" or the like, such terms usually have reference to the orientation depicted in the drawings.

It should also be understood, of course, that the invention is not limited to the particular embodiment illustrated.

DETAILED DESCRIPTION OF THE DRAWINGS

Referring collectively to FIGS. 1–6, a preferred embodiment of applicant's implement for cleaning surfaces by moving-bristle contact comprises head 10 which anchors on its lower or first side 12 a multiplicity of bristle tufts 14. In the present embodiment lower surface 12 is flat or planar in the center but has jagged angular or tooth-like surfaces at the outer extremities, which accommodate the angular disposition of the outermost bristle tufts and add to the aesthetic appearance of the implement. The bristle tufts are embedded in corresponding apertures in head 10, the apertures being angled to achieve the desired bristle distribution as indicated. The bristle tufts 14 are sized lengthwise so as to present a flat bristle-end surface 16 for maximum floor contact.

The second or upper side 18 of head 10 is substantially flat except for an upraised centrally-located, integrally-formed, connector-mating structure 20. Upraised structure 20 is semi-circular, e.g., about 200°–280°, preferably about 220°–260°. It includes axially-located pivot pins or journals 22 on each side and a toothed or gear-configured peripheral surface 24.

The user manipulates the cleaning implement by means of elongated handle 26 which may be of conventional broom-style design, e.g., solid wood, cylindrical metal or the like. Typically, it is threaded at the lower end for connection purposes. Head 10 and handle 26 are joined by means of intermediate handle interconnector 28 having an upper handle end 30 and a lower head end 32. As is apparent in FIG. 6, the internal extremity of handle end 30 of interconnector 28 is threaded to receive the corresponding threaded lower end of handle 26.

Head end 32 includes a connection assembly 34 comprising bifurcated extensions 36, manual actuator or adjuster 38 and intermediate biasing metallic spring 40, which is compressed when connection assembly 34 is assembled. Referring to FIGS. 2, 2A and 7–10, when assembly 34 is assembled, the upper portion of spring 40 is supported within open-ended cylinder 42 of head end 32 and the lower portion of spring 40 is entrapped between the slotted sides 44 of actuator 38. The slots 46 of sides 44 register with and engage guide protrusions 48 in the channel between bifurcated extensions 36, whereby a sliding fit for actuator 38 is achieved. When connection assembly 34 of interconnector 28 is assembled as portrayed in FIG. 6, spring 40 is partially compressed so as to force locking tooth 50 towards and, if aligned, into the preselected complementary slot between the teeth or ribs on peripheral surface 24 of the interconnector-mating structure 20.

The sides 44 of actuator 38 have ribbed outer contact surfaces 52 to provide a gripping surface for finger actuation of actuator 38, that is, moving it against the force of spring 40 so that locking tooth 50 can be released from the ribs of peripheral surface 24 of interconnector-mating structure 20 and the angular disposition of the interconnector 28 and handle 26 relative to the bristle-end surface 16 adjusted. Manifestly, the disposition and angular separation of the teeth on surface 24 determines the angular disposition of the handle. In the embodiment shown, the handle can be disposed vertically with respect to bristle-end surface 16, or substantially parallel thereto on either side of the vertical or at desired intermediate angles.

Figures 2, 2A:
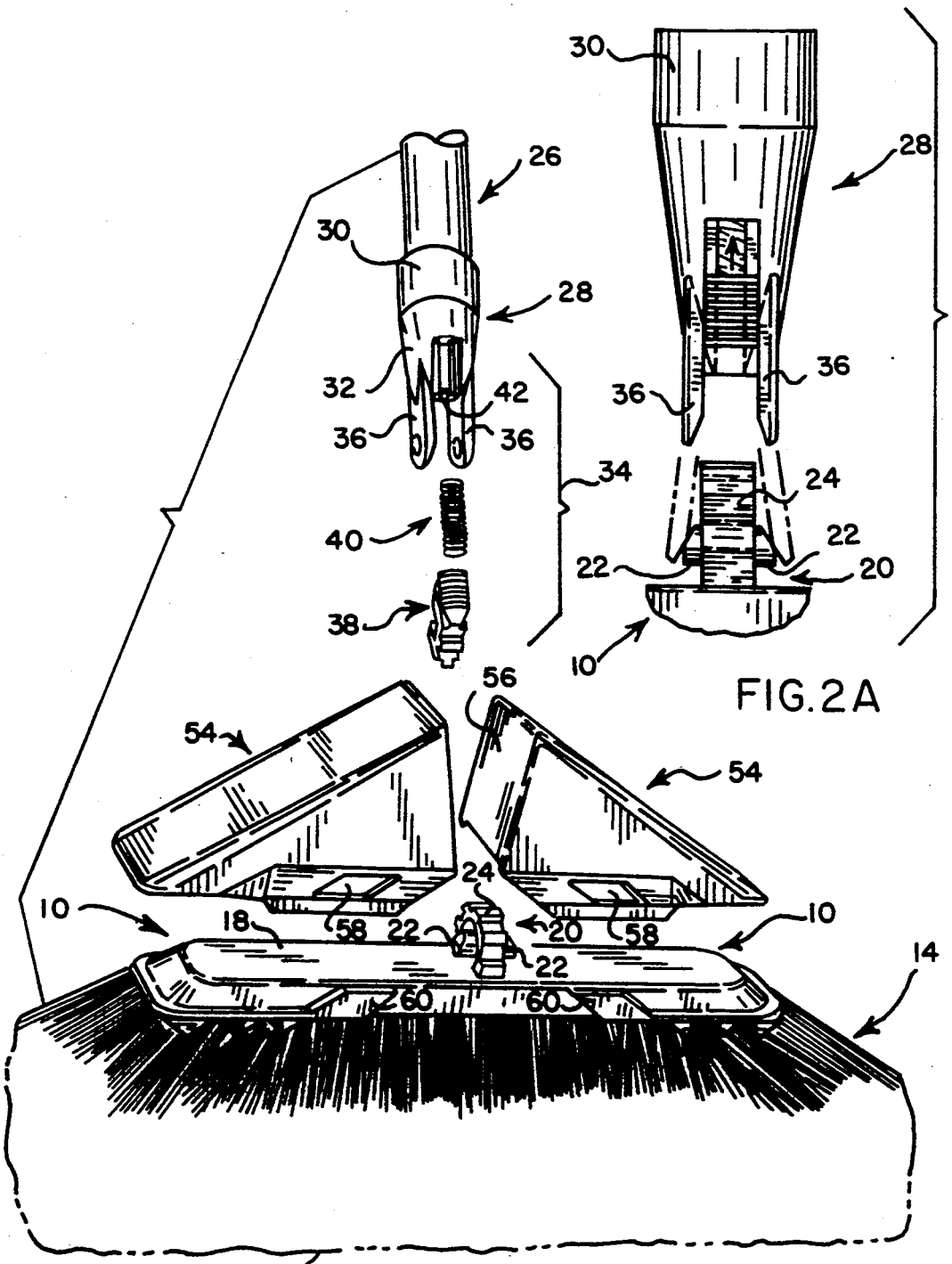
FIG. 2 is an exploded perspective view showing the components of the embodiment of FIG. 1.
FIG. 2A is a closeup view of the handle interconnector of FIG. 2, illustrating in dashed lines how the flexible bifurcated extensions are snap-fitted to the integrally-formed structure on the head, a portion of the latter also being shown.
Figure 4:
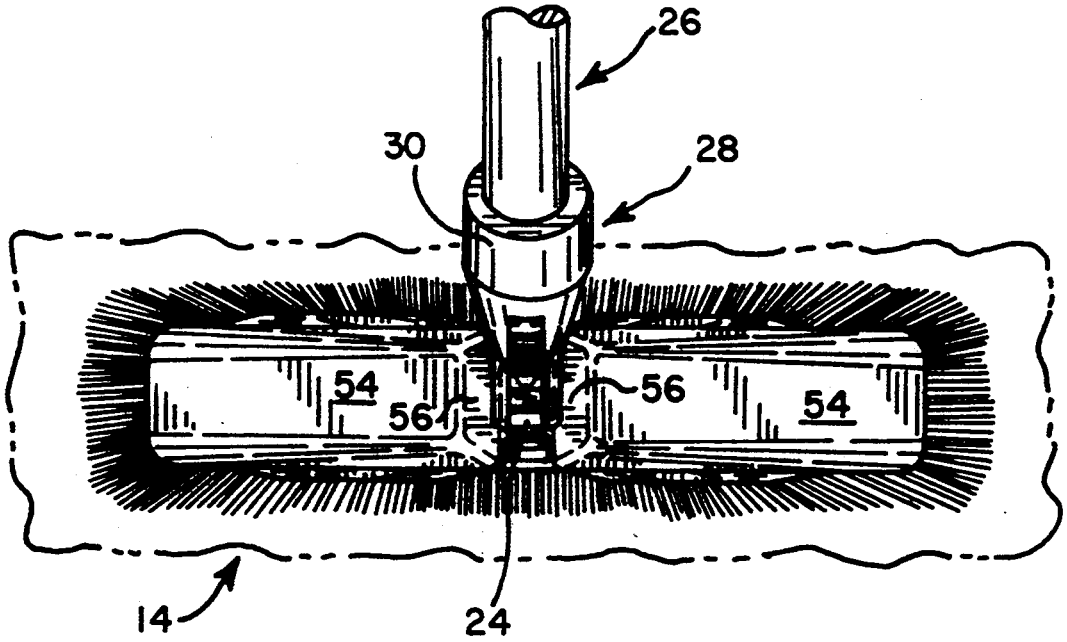
FIG. 4 is an overhead view of the embodiment of FIG. 3.
Figure 5:
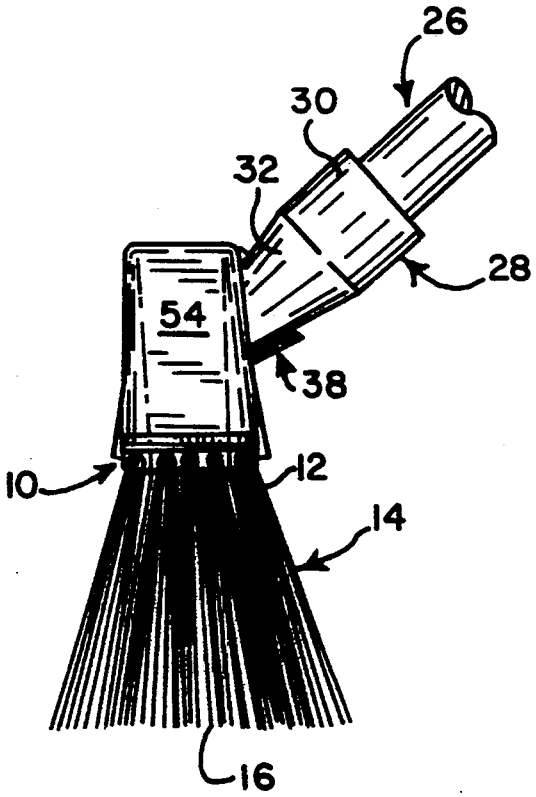
FIG. 5 is a right side view of the embodiment of FIG. 3.
Figure 6:
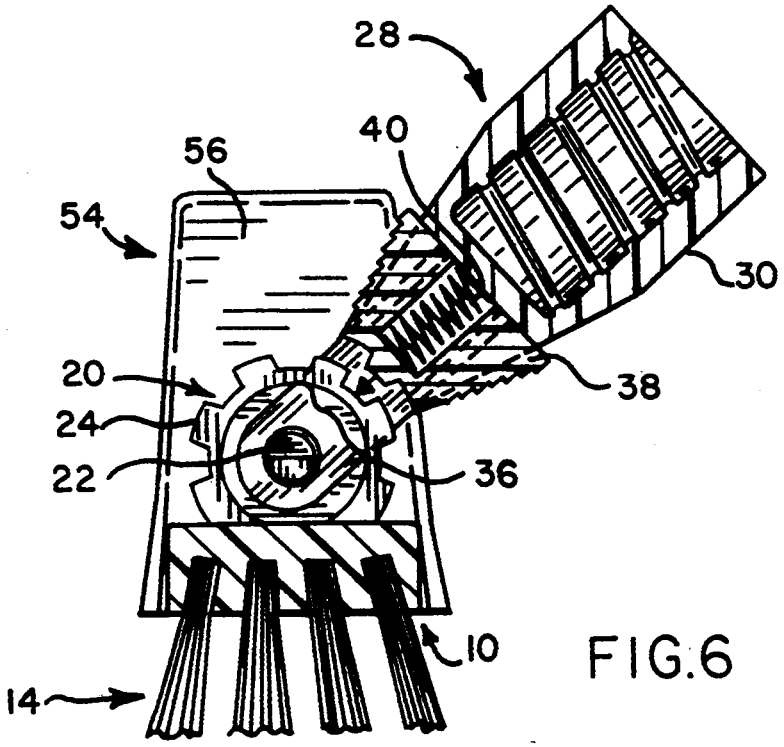
FIG. 6 is a section view taken along the line 6—6 of FIG. 3.
Figure 7:
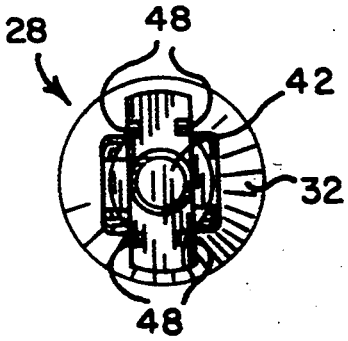
FIG. 7 is a bottom view of the detached handle interconnector shown at the upper portion of FIG. 2.
Figure 8:
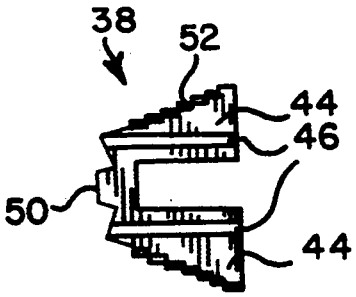
FIG. 8 is a side view of the detached manually-controlled ratchet adjuster of the hinge and locking mechanism, also shown in perspective in FIG. 2.
Figure 9:
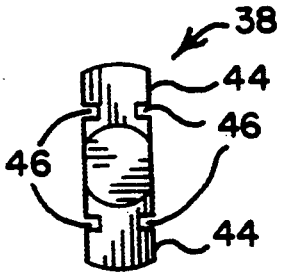
FIG. 9 is a view of the ratchet adjuster as viewed from the right of FIG. 8.
Figure 10:
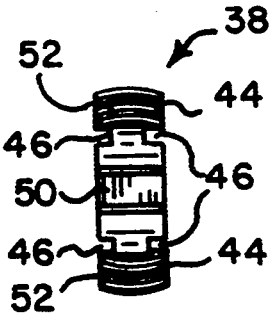
FIG. 10 is a view of the ratchet adjuster as viewed from the left of FIG. 8.

Referring to FIG. 2A, features of the present invention include the relatively-few parts required and the ease of assembly. Interconnector-mating structure 20, for example, is an integrally-formed part of head 10 and requires no separate parts or assembly. Handle interconnector 28, with spring 40 and actuator 38 inserted as above described, is snap fitted to interconnector structure 20 as shown by the dashed lines in FIG. 2A. to facilitate the same, the distal ends of bifurcated extensions 36 and the corresponding surfaces of pins 22 are mutually beveled so that extensions 36 are flexed outwardly until the apertures of extensions 36 are aligned with the extremities of the pivot pins 22, whence the snap fitting is automatically completed.

To inhibit any tendency of the snap fitting from becoming undone, a particularly-preferred embodiment includes detachably-mounted supplemental interference structures 54, which also enhance the aesthetic appearance of the cleaning implement. The lower portions of opposed inner-facing surfaces 56 of structures 54 abut against, or are sufficiently close to, the distal ends of pins 22 that the bifurcated extensions 36 can not be flexed outwardly sufficiently to be released from the pins.

The addition of structures 54 does not significantly complicate the implement. Structures 54 are added after assembly of the implement by simply snap fitting it to head 10. This is facilitated by apertures 58 on each side of structures 54 which interlock with matching protrusions 60 on the sides of head 10. As in the case of interconnector-mating structure 20, protrusions 60 are integrally-formed in the sides of head 10 whereby they are included in the basic molding step or equivalent. By simplification of the design, use of snap fittings and the like, the cleaning implement of the present invention lends itself to tool-less assembly.

In a preferred embodiment, head 10, interconnector 28 and actuator 38 are molded from high-density polyethylene or equivalent; the bristles comprise nylon; and structures 54 comprise polypropylene, polyvinyl chloride or the like. The materials of construction are not per se the inventive contribution and are known to those skilled in the art.

It is to be understood that allowed claims based directly or indirectly on this application are to be accorded a range of equivalence commensurate in scope with the advance made over the prior art.

Having described the invention, what is claimed is:

1. An implement for cleaning surfaces by contact with bristles comprising:

(a) a head having a first side and an opposed second side, said first side anchoring a plurality of bristles presenting a substantially-flat bristle-end surface for contact with surfaces to be cleaned, said second side having an integrally-formed interconnector-mating structure thereon, said integrally-formed interconnector-mating structure comprising a semi-circular upraised portion on said second side, having opposed pivot pins adjacent the axial center of said semi-circular upraised portion and extending outwardly therefrom, and tooth projections on the semi-circular periphery of said upraised portion;

(b) an elongated handle for manipulation of the cleaning implement by the user thereof;

(c) a handle interconnector intermediate said head and said handle and having a head end and a handle end, said handle being detachably secured to said handle end; and (d) a connection assembly disposed on said head end of the handle interconnector and ratchetably-pivotally secured to said integrally-formed interconnector-mating structure on the second side of said head whereby said handle interconnector and said handle can be selectively-pivoted in a single plane and locked at predetermined desired angles relative to said substantially flat bristle surface, the angles ranging from the vertical to substantially parallel relationships on either side of the vertical relative to the plane of said substantially-flat bristle-end surface, said connection assembly comprising bifurcated extensions of said head end of said handle interconnector having opposed apertures therein for pivotal connection to said pivot pins of said integrally-formed structure on said second side of said head; said pivot pins and distal ends of said bifurcated extensions being mutually beveled to facilitate a snap-fitting assembly.

2. An implement for cleaning surfaces by contact with bristles comprising:

(a) a head having a first side and an opposed second side, said first side anchoring a plurality of bristles presenting a substantially-flat bristle-end surface for contact with surfaces to be cleaned, said head having an integrally-formed upraised structure on said opposed second side thereof;

(b) an elongated handle for manipulation of the cleaning implement by the user thereof;

(c) a handle interconnector intermediate said head and said handle and having a head end and a handle end, said handle being detachably secured to said handle end;

(d) a connection assembly disposed on said head end of the interconnector and ratchetably-pivotally secured to said integrally-formed structure on the second side of said head whereby said handle interconnector and said handle can be selectively-pivoted in a single plane and locked at predetermined desired angles relative to said substantially-flat bristle-end surface, the angles ranging from the vertical to substantially parallel relationships on either side of the vertical relative to the plane of said substantially-flat bristle-end surface;

(e) said integrally-formed upraised structure comprising a semi-circular upraised portion on said second side, having opposed pivot pins adjacent the axial center of said semi-circular upraised portion and extending outwardly therefrom and tooth projections on the semi-circular periphery of said upraised portion thereof; and (f) said connection assembly comprising bifurcated extensions of said head end of said interconnector having opposed apertures therein for pivotal connection to said pivot pins of said integrally-formed structure on said second side of said head;

said pivot pins and distal ends of said bifurcated extensions being mutually beveled to facilitate a snap-fitting assembly.

3. The cleaning implement of claim 2 including a supplemental interference structure detachably mounted on said head to inhibit disassembly of the snap-fitting assembly.

* * * * *